US006132057A

United States Patent [19]

Williams

[11] Patent Number: 6,132,057

[45] Date of Patent: Oct. 17, 2000

[54] NIGHT LIGHT FOR ILLUMINATING DOOR KNOBS

[76] Inventor: Christine Janet Williams, P.O. Box 216, 11 Salem Hill Rd., South Salem, N.Y. 10590

[21] Appl. No.: 09/225,673

[22] Filed: Jan. 6, 1999

[51] Int. Cl.[7] ..... E05B 17/10

[52] U.S. Cl. ..... 362/100; 362/396; 362/576; 362/191

[58] Field of Search ..... 362/576, 100, 362/396, 190, 191, 800; D26/27

[56] References Cited

U.S. PATENT DOCUMENTS 3,719,821 3/1973 Foreman ..... 362/100

4,310,873 1/1982 Bean ..... 362/100

*Primary Examiner*—Stephen Husar

*Attorney, Agent, or Firm*—John P. Halvonik

[57] ABSTRACT

The invention is an illuminating device for doorknobs. The apparatus comprising an acrylic prism of a horseshoe shaped and of a size that allows it to fit over a standard sized door knob and then reside upon the back plate of the door knob. The prism is lit by two LED devices located at either end of the prism and powered by small batteries. The device illuminates door knobs or handles with a minimum of electrical power and easy to use for people of all ages.

2 Claims, 2 Drawing Sheets

NIGHT LIGHT FOR ILLUMINATING DOOR KNOBS

FIELD OF THE INVENTION

The invention relates to the field of night lights and related illuminating apparatus, in particular, the invention herein is used to illuminate door knobs and provides low cost, low power, source of illumination for such.

BACKGROUND AND PRIOR ART

While there are night lights that are known in the prior art there are none that are believed to illuminate the doorknob area using a low power source of light and none that are designed to be supported by resting upon the doorknob plate. Nor are there any lighting units that are of a horseshoe shape so as to illuminate the door knob and thus make it easy to locate in the dark.

It is thought that a doorknob lighting apparatus would be very much appreciated for those who need to leave the bed room at night or for emergencies. Such an apparatus is believed to find its greatest usage in illuminating the door knob area at night so that one does not have to fumble around trying to locate the door knob. As anyone with experience can attest to, locating even immovable objects can become quite a chore in the dark as the darkness seems to exaggerate distances and such in the night so that one finds himself groping along the wall for a light switch that he is well accustomed to using during the day.

While there are night lights available to people, these are constructed to be in close contact with the wall outlet and thus they are typically found low to the floor. In any case, they are of low power and cannot illuminate a door knob unless they are in close connection with it. To this end, the device described herein addresses itself, The device is constructed so that it will fit over the door knob and rest upon the back plate of the doorknob. It is shaped in a horseshoe shape so that will outline roughly the position of the doorknob.

It is believed that using the doorknob back plate provides a convenient resting place for the device herein described and thus the device is constructed of a shape that will permit it to be hung upon this structure.

It is believed that the invention described herein will find its greatest utility in functioning in the manner of a night light for the door knob. That is, it will most likely be used at night in order to provide a steadily lit semi circular portion around the area of the door knob. The device is likely used on different door knobs in areas that the person is sleeping near, such as the bed room or bathroom.

It is believed that there are benefits to illuminating door knobs. For safety reasons, it is important that such knobs be readily lit so that a small child or an elderly person can readily evacuate the room in case of emergency. Moreover, even with night lights in use, there is still a need to have the door knob area illuminated so that people do not have to stumble around in the dark groping for the handle.

SUMMARY OF THE INVENTION

The invention is an illuminating device for doorknobs. The apparatus comprising a horseshoe shaped acrylic prism of a size that allows it to fit over a standard sized door knob and then reside upon the back plate of the door knob. An electrical circuit is powered by two batteries and includes an on/off switch. The circuit provides power for LSD devices located at either end of the prism and these LEDs then illuminate the length of the horseshoe shaped prism.

It is among the objectives to provide an illuminating device for door knobs that can function at low power and so provide constantly illuminated door knob that is easy to manufacture and use.

It is among the objectives to provide an illuminating device for door knobs that will provide a shape to indicate the position of the doorknob and so make it easy for the user to locate the position of the doorknob very quickly.

It is among the objectives to provide an illuminating device for door knobs that will be on throughout the night and that will not consume a large amount of electrical power in the process.

Another objective is to provide a lighted device to discern the location of a door knob in an otherwise darkened room.

Another objective is to provide an illuminating device for door knobs that is easy to use and can readily be manipulated by those with less than optimum dexterity such as the elderly.

Other objectives will be apparent once the invention is shown and described.

DESCRIPTION OF THE PREFERRED EMBODIMENT

Figure 1:
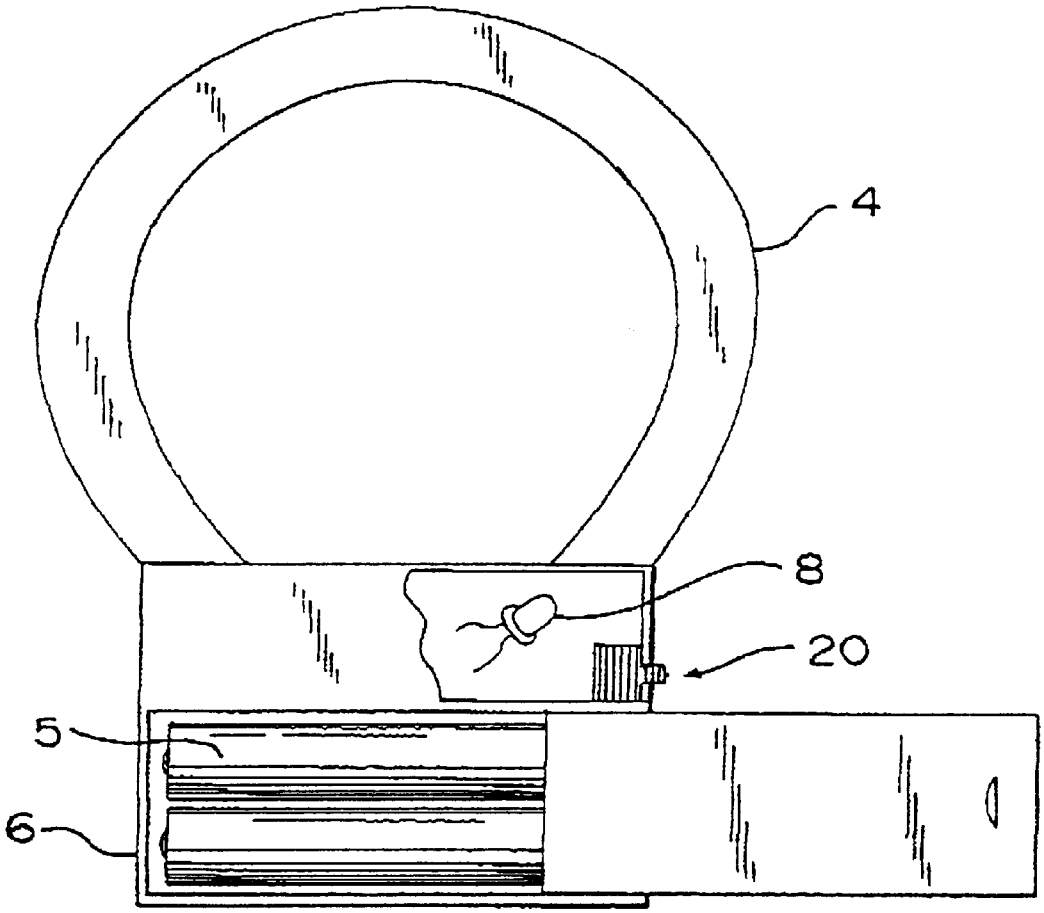
FIG. 1 overall construction of the apparatus.

The overall construction of the apparatus is shown in FIG. 1, there is a compartment 6 for holding batteries 5 to power the circuit. The batteries may be of various size but it is thought that small double or triple A batteries will suffice for the purpose of the invention. The batteries are in electrical connection with a circuit that powers lighting elements located at either end of an acrylic member 4. The circuit includes an on/off switch so that the user can turn the light on and off by moving the switch.

The lighting elements are in connection with the horseshoe shaped acrylic member or prism. Such member is shaped in this manner so that it can be placed over a door knob 12 and then rested upon the doorknob plate 10 shown in FIG. 1. The prism may also fit into a narrow trough or notch 15 that exists around many door knobs. It is preferred that the lighting element be made of an acrylic material. Such materials are readily available nowadays and this material is preferred because it can be made in various shapes without impacting the structural integrity of the component. It is preferred that the inside diameter of the horse shoe shaped prism be about 2.5".

Figure 4:
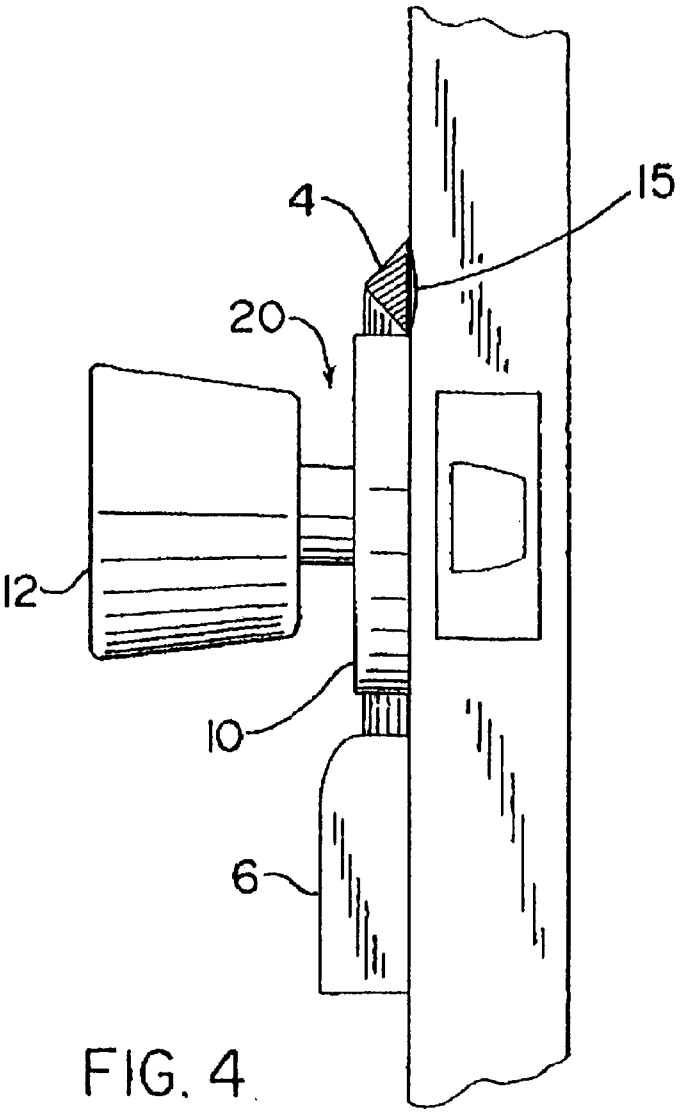
FIG. 4 side view.
Figure 3:
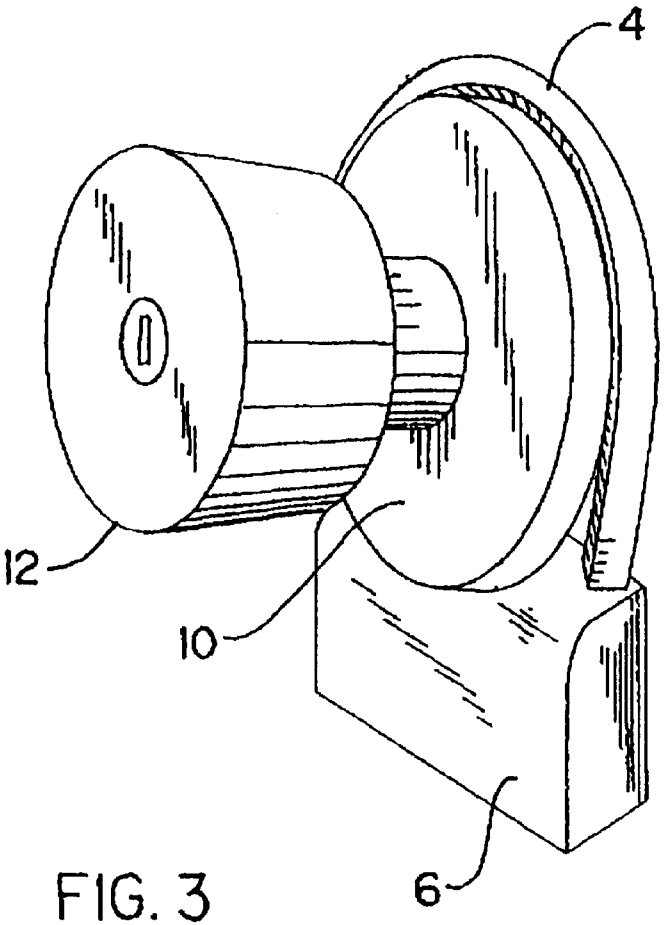
FIG. 3 perspective view of apparatus in use.

It is preferred that the cross section of the prism be triangular as seen in FIG. 4. The triangle would preferably be isosceles and one side of the triangle will be against the door as seen in FIG. 4. The triangular shaped cross section of the prism will aid in keeping the prism in place as the prism will sit in the slight notch 15 that exists where the door knob plate meets the door and typically runs in a circular fashion around the door knob fixture.

This acrylic material also lends itself to use with lower powered sources of illumination such as LEDs, because the material is translucent and will tend give off a faint glow when there is a minor source of light at one or both ends of the material. A faint glow is, of course, desirable because one does not want to cast the entire room in direct light as that would interfere with the person trying to sleep. However, it is faint enough so that it can illuminate the pertinent portions of the door knob area and without consuming much electrical power. These considerations thus make it an ideal material for this application.

Figure 2:
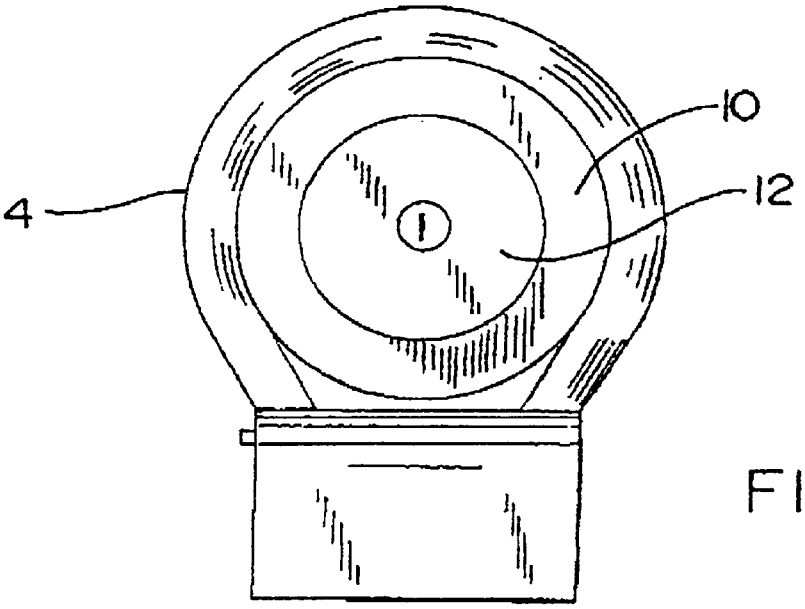
FIG. 2 front view of apparatus in use.

The horseshoe shape of the prism thus lends itself to the user quickly locating the position of the doorknob, 12 in FIG. 2. As the apparatus fits over the doorknob 12, the horse shoe shape will thus outline the position of the doorknob. Also the shape of the apparatus will not interfere with the operation of the doorknob and it will not affect one's grip on the doorknob. The shape also allows this night light to be portable so that it may be hung on different door knobs by simply taking it off one doorknob and hanging it on another. The invention is thus portable by virtue of the shape of the lighting element. The prism can also hang in the area of arrow 20 in FIG. 4.

It is preferred that LEDs 8 (light emitting diodes) be used to provide a source of light in order to illuminate the ends of the acrylic member. Such diodes do not consume large amounts of power (i.e. they are low wattage) even when they are in operation throughout the night. It is preferred that two such LEDS be used, one at either end of the acrylic member. One of them is shown in FIG. 1. AS the acrylic is translucent to light, a source of light at either end will permit light to be transmitted throughout the member and so the prism will appear to glow when it is turned on.

The surface of the acrylic member may be treated so as to give it a frosted type of surface. This can done by a sanding or sandblasting process which will roughen the surface of the acrylic material and so make it transmit light in a more even manner than were it to remain a smooth surface. Materials similar to acrylics, that allow light to be diffused throughout the material, may also be used without violating the spirit of the invention.

Optional embodiments include the use of a light sensor in connection with the electrical circuit so that operation of the light can be turned off and on automatically when the room gets darker. A touch switch can be used instead of a manual type of switch.

I claim:

1. An illumination device for door knobs comprising an illumination piece of horse shoe shape and of size sufficient to fit over standard sized door knobs, said illumination piece comprised of acrylic material and having a triangular cross section, illuminating means at each end of said illumination piece, said illuminating means in connection with an electrical circuit for powering said illumination means.

2. The apparatus of claim 1 wherein illumination means comprises a pair of LEDs.

* * * * *